US006216820B1

(12) United States Patent
Van Mol

(10) Patent No.: US 6,216,820 B1
(45) Date of Patent: Apr. 17, 2001

(54) ELEVATING WORK PLATFORM

(75) Inventor: Johannes C. F. G. Van Mol, Dlessen (NL)

(73) Assignee: HEK Manufacturing B.V. (NL)

( * ) Notice: Subject to any disclaimer, the term of this patent is extended or adjusted under 35 U.S.C. 154(b) by 0 days.

(21) Appl. No.: 09/402,842

(22) PCT Filed: Apr. 8, 1998

(86) PCT No.: PCT/EP98/02050

§ 371 Date: Oct. 12, 1999

§ 102(e) Date: Oct. 12, 1999

(87) PCT Pub. No.: WO98/46517

PCT Pub. Date: Oct. 22, 1998

(30) Foreign Application Priority Data

Apr. 11, 1997 (DE) ..... 197 15 176
Apr. 23, 1997 (DE) ..... 197 17 060

(51) Int. Cl.[7] ..... E04G 1/20
(52) U.S. Cl. ..... 182/141; 182/146
(58) Field of Search ..... 182/141, 145, 182/146, 18, 136; 16/275, 276, 371

(56) References Cited

U.S. PATENT DOCUMENTS 1,848,427 * 3/1932 Leister ..... 16/276
3,516,512 * 6/1970 Kupke ..... 182/141
3,851,728 * 12/1974 Williams ..... 182/146
4,293,054 * 10/1981 Pieri ..... 182/146
5,555,952 * 9/1996 Van Mol ..... 182/141
5,884,725 * 3/1999 Reyland ..... 182/82

* cited by examiner

*Primary Examiner*—Alvin Chin-Shue
(74) *Attorney, Agent, or Firm*—Locke Liddell & Sapp LLP

(57) ABSTRACT

The invention relates to an elevating work platform having a working platform (16) which can move vertically upwards on at least two parallel masts (3, 4), and which has a carriage (14, 15) for each mast (3, 4). The carriage (14, 15) is guided on the respective mast (3, 4) and has a driving unit. The working platform (16) is supported on the carriage (14, 15) by means of joining elements (40), and power transmission between the mast (3, 4) and the carriage (14, 15) takes place by positive locking. The invention seeks by simple means to compensate the movement of the working platform (16) in relation to the masts (3, 4). This is necessary due to the load to which the working platform (16) is subjected and due to construction tolerances, and so as to prevent high levels of tension in the devating work platform. To this end, the joining elements (40) between each carriage (14, 15) and the working platform (16) are so configured that the working platform (16) can be partially displaced along its longitudinal axis in relation to the carriages (14, 15), and can partially rotate at right angles to its longitudinal axis in it relation to the carriages (14, 15).

9 Claims, 5 Drawing Sheets

ELEVATING WORK PLATFORM

Figure 1:
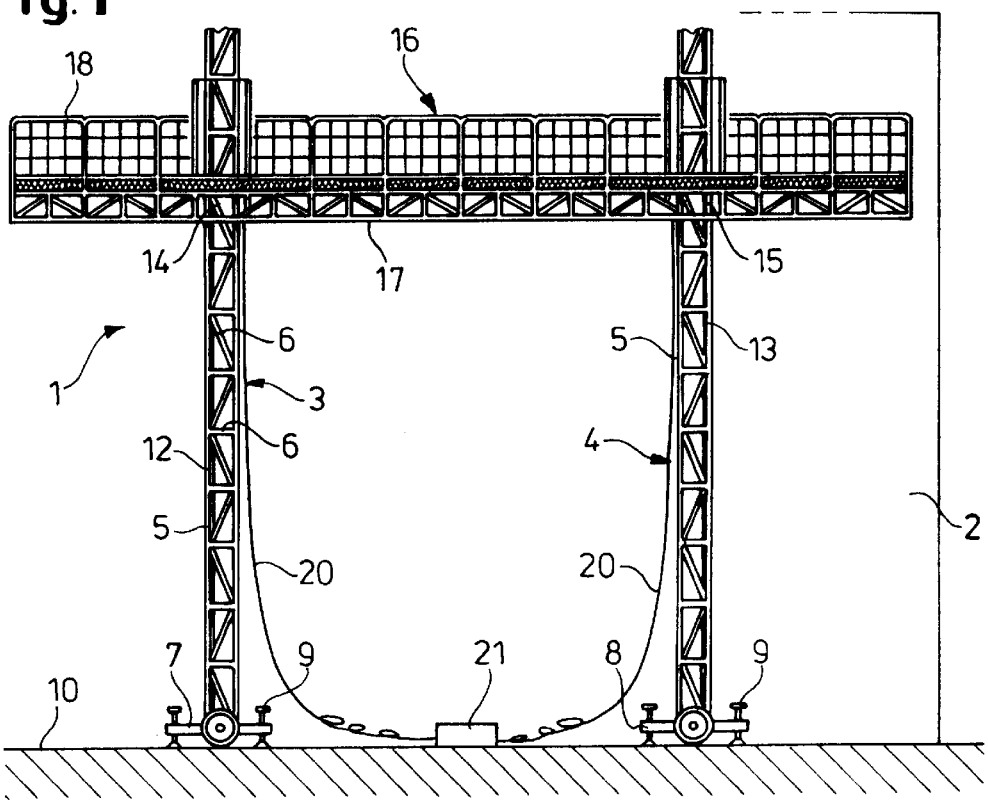

This application claims priority to German application numbers 197 15 176.0, filed Apr. 11, 1997, and 197 17 060.9, filed Apr. 23, 1997 and European Application Number PCT/EP98/02050.

This invention relates to an elevating work platform comprising a working platform which is guided for vertical movement on at least two mutually parallel masts, and which has a carriage for each mast which is guided on the respective mast and has a driving unit, wherein the working platform is supported on the carriage by means of joining elements, and power transmission between the mast and the carriage takes place by positive locking.

Elevating work platforms of this kind are known from prior art. The same are as a rule raised instead of scaffolds in the area of building facades. The working platform of such an elevating work platform encompasses the masts on at least three sides, wherein it is usual that the working platform also laterally protrudes beyond the two masts. The masts consist of mast elements which are arranged course by course one on top of the other and are connected to each other, so that masts of a desired elevation can be raised from a plurality of mast elements. For power transmission a driving unit is normally used which is arranged on a motor supporting plate and has at least one electric motor with a transmission unit flanged to it. The motor supporting plate is part of the carriage, wherein the transmission unit includes on the output side at least one output pinion meshing with a rack which is fixed to the mast.

With elevating work platforms of this kind the problem exists that, although motor control is correspondingly monitored, the driving power is different on the two masts, which fact may in case cause a slight difference of level of one carriage compared to the other. This difference of level may be the result of uneven loading of the working platform and causes that the working platform is not always fully horizontally aligned. An inclination of the working platform thus produced leads to material stress both in the masts and the working platform together with the connected driving members, by which material stress the structural components are subjected to undesired loads. In addition, it is necessary that the corresponding loads are determined and are used for controlling the elevating work platform. This requires the driving motors to be switched off if inadmissible loads occur in the elevating work platform.

Starting from this prior art the invention is based on the object of further developing an elevating work platform in such a way as to make it possible by simple means to compensate the movement of the working platform relative to the masts, which compensation is necessary due to the load to which the platform is subjected and due to construction tolerances, so that high levels of tension in the elevating platform are avoided.

The solution of this problem provides for the joining elements between each carriage and the working platform being so configured that the working platform is supported both for a limited displacement relative to the carriages in its longitudinal axis direction and for a limited rotation relative to the carriages at right angles to its longitudinal axis direction.

By the configuration according to the invention of this elevating work platform it is guaranteed that the working platform is movable relative to the masts to such an extent that a slightly different running of the driving motors for both carriages can be compensated. Namely, the working platform can be moved relative to the carriages in its longitudinal axis direction as well as relatively rotated about the carriages. Of course, these relative movements are possible only to a very limited extent in order not to have a negative influence on the working safety of such an elevating work platform. But due to the mobility of the working platform relative to the carriages moments in the junction points between the carriages and the working platform are considerably reduced. In addition, tension is reduced also in the masts and particularly in the driving elements, i.e. the racks and the pinions of the driving units meshing with the racks.

According to a further feature of the invention it is provided that the joining elements consist of a rod cylindrical in cross-section and of a spherical member supported in a holding device. The rod tends to enable an axial displacement of the working platform relative to the carriages, whereas the spherical member enables the working platform to rotate relative to the carriage.

Preferably, the rod is connected to the working platform, and the spherical member is movable relative to the rod. Consequently, the rod is configured to be stationary, whereas the spherical member is movable along the rod.

The rod is, according to a further feature, supported in a bore penetrating the spherical member. Consequently, the spherical member can be moved relative to the rod in the longitudinal axis direction thereof and rotated about the rod.

Each carriage preferably has two rods which are supported in corresponding spherical members, one of the rods being arranged in the vicinity of the carriage and the other one on the end of the working platform, which is spaced from the carriage. The carnage preferably has a motor supporting plate with supporting profiles which are arranged at right angles to the working platform and on which the working platform takes support. The motor supporting plate includes an opening which is penetrated at least by the output pinions in order that the same mesh with the rack. The transmission unit is fixed with a housing to the motor supporting plate, preferably by means of screws, and carries on its end opposite to the motor supporting plate the driving motor which together with its shaft carrying the driving pinion protrudes into the transmission unit and is screwed to the transmission housing.

The holding device for the spherical member is configured as a pot-shaped bearing shell which has radially opposing openings that receive the rod. These openings also determine an angle of pivoting of the rods about the longitudinal axis of the bearing shell. In this way a further degree of freedom of the rod relative to the bearing shell and, accordingly, to the carriage is determined.

Preferably, the bearing shell is covered by a lid. The bearing shell can, in the usual manner, be filled with a lubricant such as grease, for example, in order to guarantee movement of the spherical member within the bearing shell free of wear. It is, however, also conceivable for the bearing shell and/or the spherical member and/or the rod to have a wear-reducing surface coating, for example polytetrafluor ethylene, in the region of the spherical member. The lid placed onto the bearing shell prevents the penetration of dirt particles such as mineral grains, dust or the like. It must be taken into account here that elevating work platforms as presently discussed are used in construction sites where a corresponding amount of dirt is to be expected.

According to a further feature of the invention it is provided that the holding device is supported on a profile of the carriage, under the interposition of a force-sensing device. In this way the static load of the working platform can be measured by means of this force-sensing device. If the static load of the working platform reaches an inadmissible high value which is predetermined in a computer, the drive will be blocked through this computer. In this case the starting, i.e. moving of the platform is inhibited until it is signalized by the force-sensing device that this inadmissible high load of the working platform does no longer exist.

The force-sensing device preferably is in the form of a wire strain gauge. Finally, according to a further feature of the invention it is provided that the carnage includes two joining elements with associated force-sensing devices. This enables the loads of the working platform to be measured in the longitudinal direction and in a direction at right angles to the longitudinal direction of the working platform. The direction which is at right angles to the longitudinal direction of the working platform lies in, the surface plane of the working platform, so that through the two directional vectors of these loads a plane of forces is determined which by means of a corresponding computer also reveals the signaling of an overload in the position exactly where it occurs.

Figure 2:
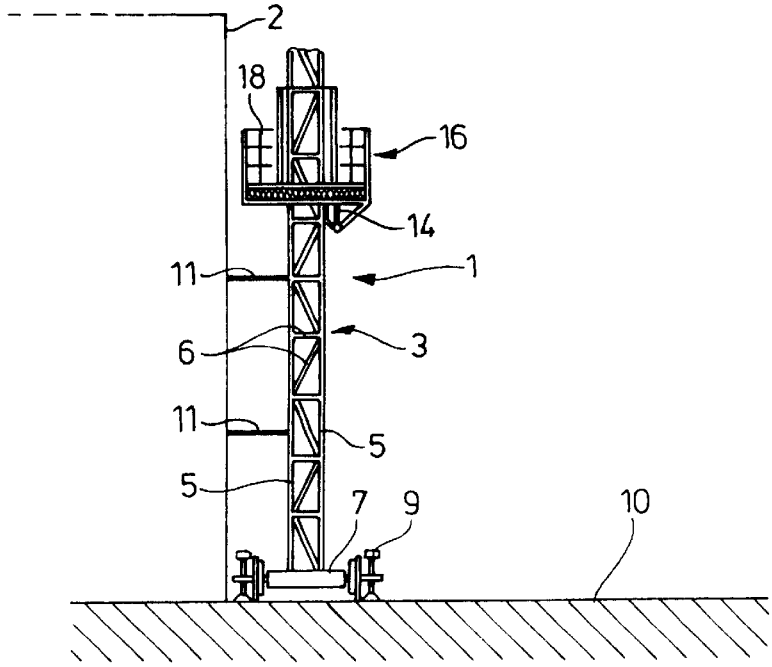
Figure 3:
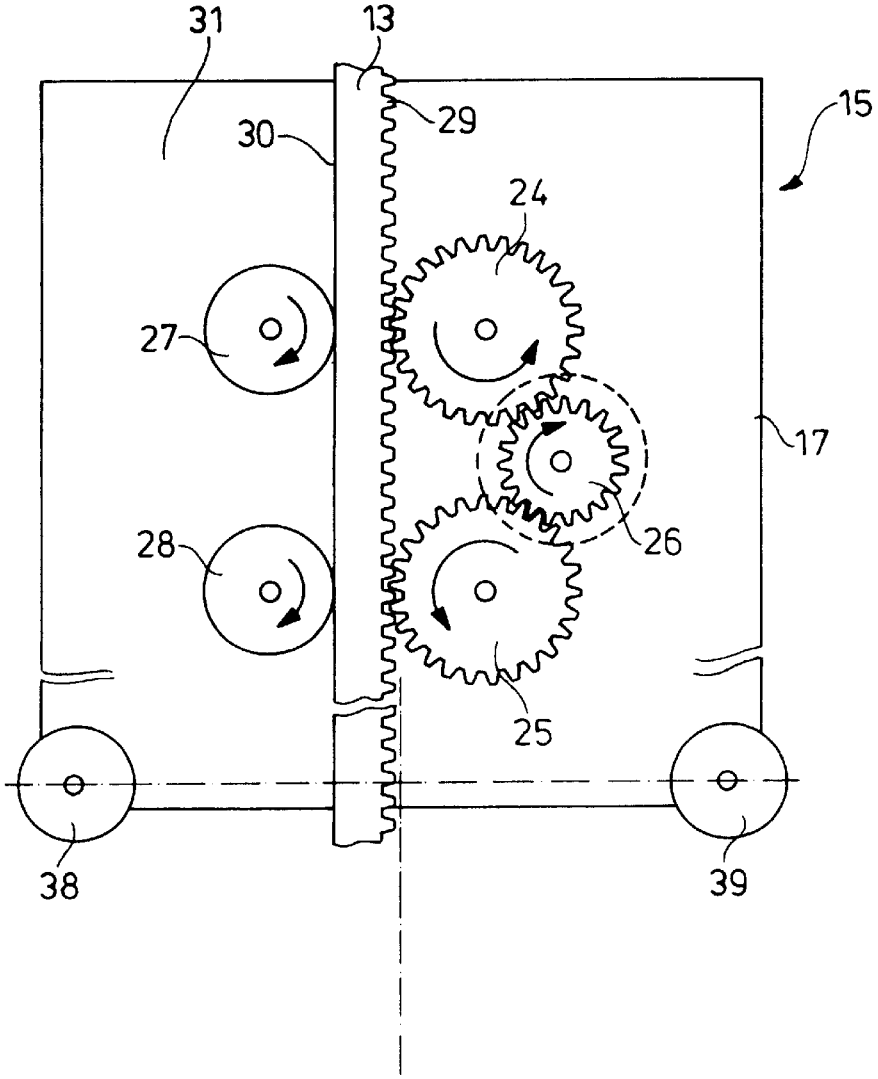
Figure 4:
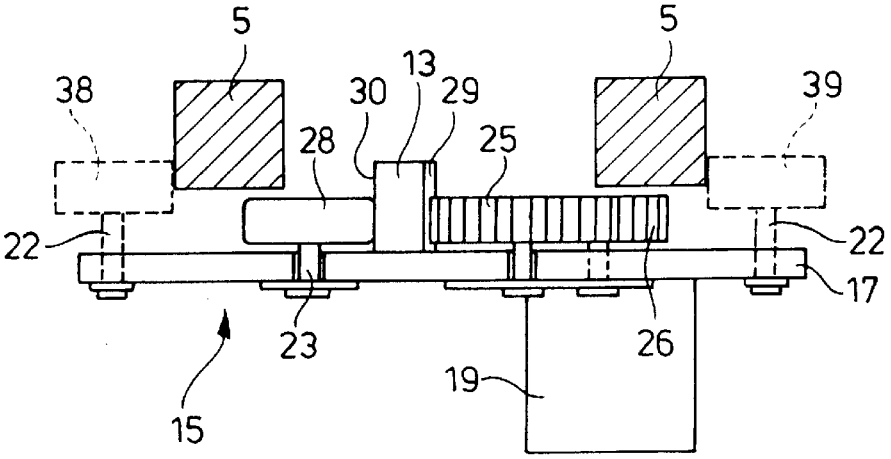
Figure 5:
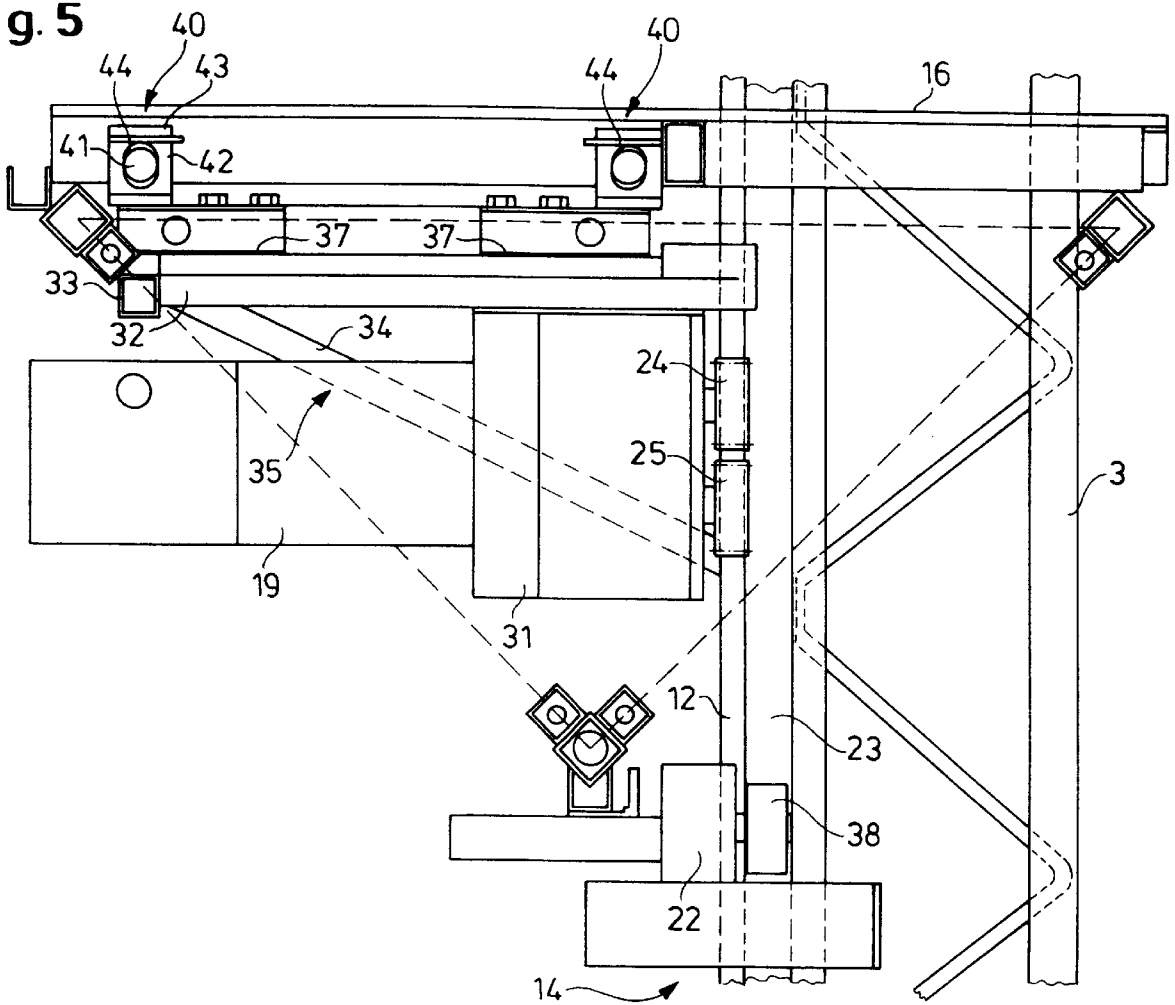
Figure 6:
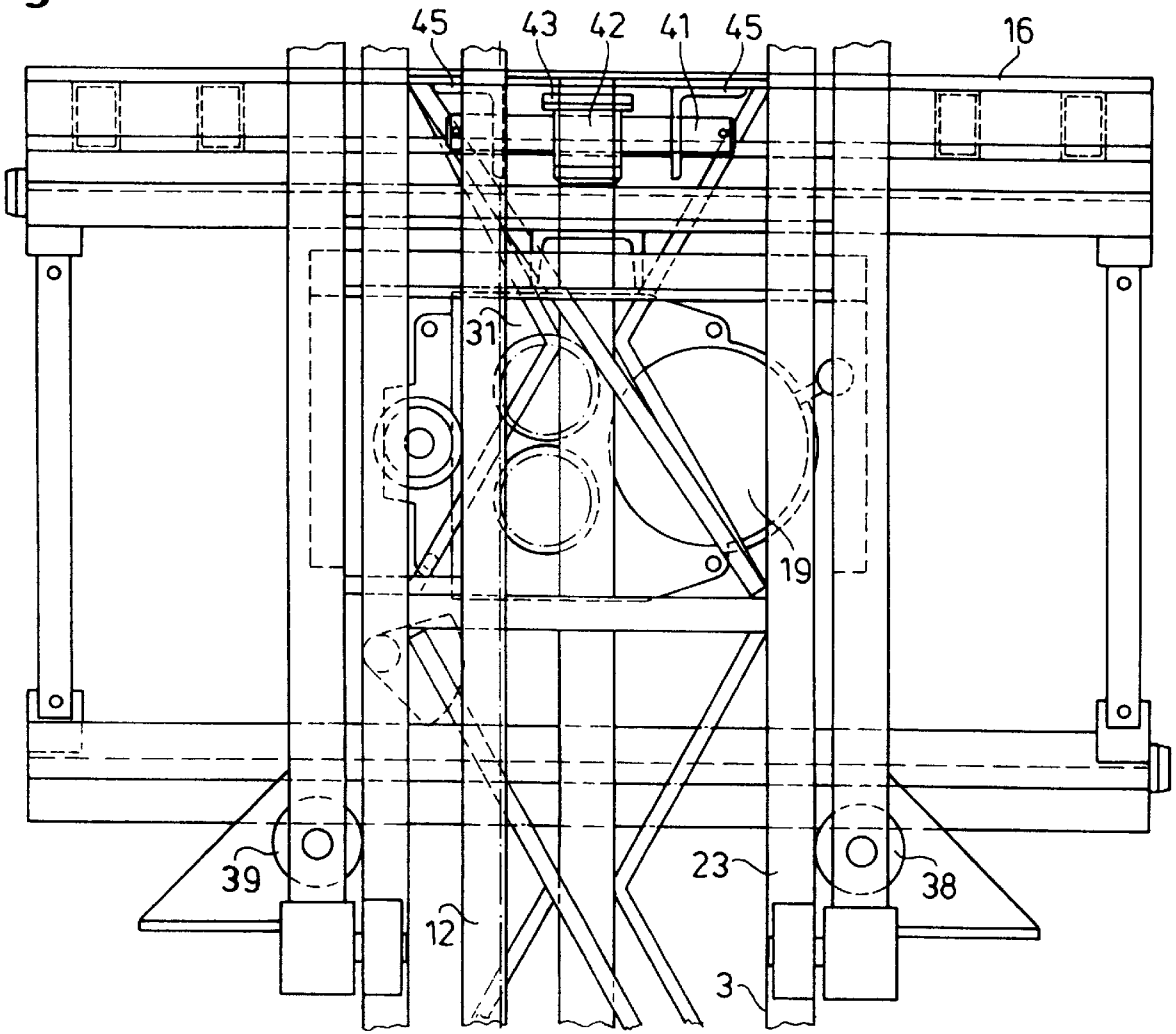
Figure 7:
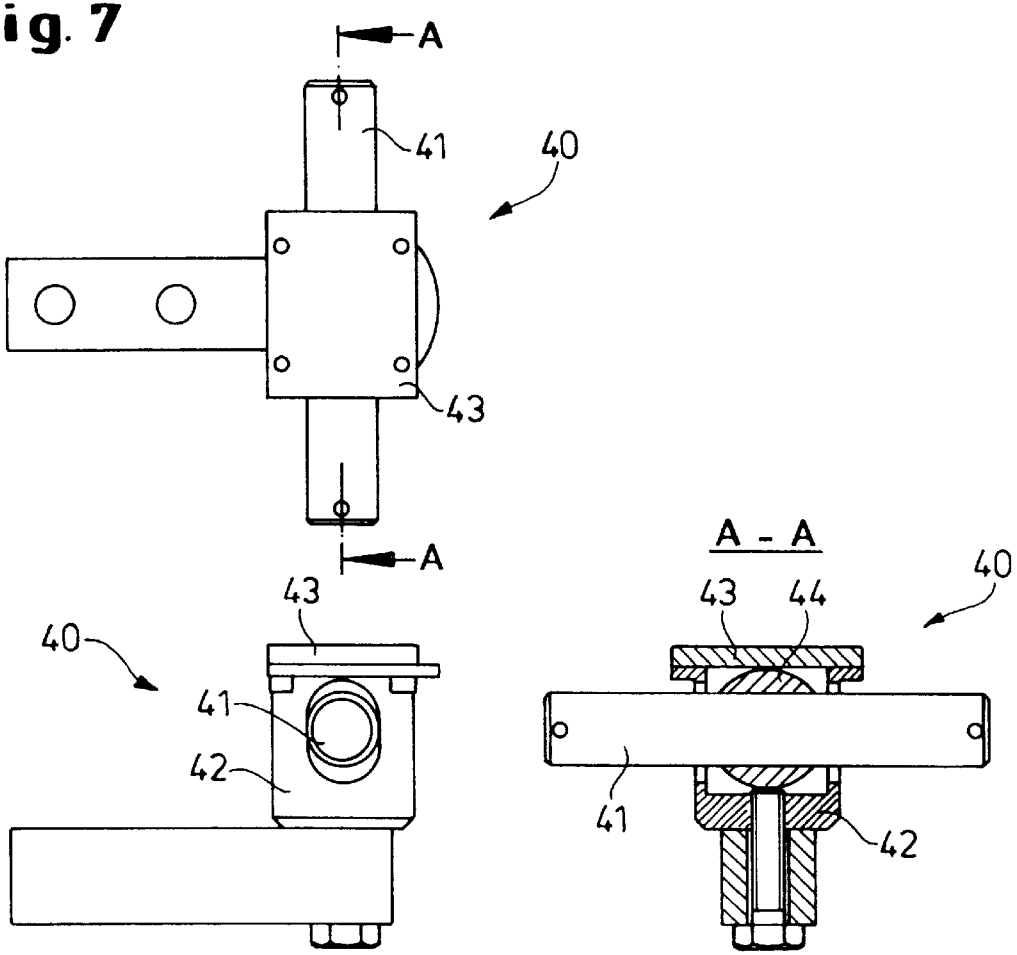

Further features and advantages of the invention become apparent from the following description by way of the drawings representing a preferred embodiment of an elevating work platform according to the invention. In the drawings it is shown by:

FIG. 1 a projection of an elevating work platform;

FIG. 2 the elevating platform according to FIG. 1, in a lateral view;

FIG. 3 a carriage with a schematically represented transmission unit for the elevating work platform according to FIGS. 1 and 2, in a lateral view;

FIG. 4 the schematically represented carriage according to FIG. 3, in a plan view;

FIG. 5 the mast-guided carriage of the elevating work platform according to FIG. 1, in a lateral view;

FIG. 6 a projection of the carriage according to FIG. 5;

FIG. 7 a joining element between the working platform and the carriage, in three projections.

FIG. 1 shows an elevating platform 1 which is arranged in front of a building 2. The elevating platform 1 consists of two masts 3 and 4 which consist of individual mast elements 5 and 6 which are are arranged one on top of the other and are connected to each other for forming the masts 3 and 4. Each mast 3, 4 has a mast base 7, 8 which touches a contact surface 10 through height-adjustable supporting legs 9.

The masts 3, 4 are connected to the building facade through anchorages 11.

Each mast 3, 4 includes a rack 12, 13 which is fixed to the mast 3, 4 on the external side, said rack 12, 13 being divided in individual sections which substantially have the same length as the individual mast clements 5, 6.

On the masts 3, 4 a carriage 14, 15 is respectively arranged in such a manner that it can be displaced along the masts 3, 4. The carriages 14, 15 are interconnected via a working platform 16. Consequently, said working platform 16 can be arranged by means of the carriages 14 and 15 in different levels in front of the building 2 in order to perform corresponding jobs on the facade. For reasons of safety the working platform 16 comprises a railing 18 which substantially leads all around.

FIGS. 3 and 5 show a carriage 15. For reasons of simplification of the constructional configuration said carriage 15 is merely shown as a rectangular surface.

The carriage 15 consists of a plate configured as a motor supporting plate 22 which on the lower edge thereof has two axles, on the free ends of which two guide rolls 38 and 39 are supported for rotation. These guide rolls 38 and 39 run on the outer surfaces of the mast elements 5 and serve for guiding the carnage 15 along the mast 4.

In addition, said plate of the carriage 15 has guide rolls 27 and 28 supported for rotation on at least one further axle. These guide rolls 27 and 28 rest against the rear side 30 of the rack 13 and roll off against the rear side 30 of the rack. On the rack surface opposite to the rear side 30 of the rack the toothing 29 of the rack 12 is arranged.

Furthermore, the plate of the carriage 15 carries a driving motor 19 which with its motor shaft indirectly acts upon a pinion 26 which either directly meshes with the rack or with two output pinions 24 and 25 meshing in turn with the toothing 29 of the rack 13. Consequently, the torque of the driving motor 19 is transmitted to the rack 12 arranged stationary on the masts 3 and 4 through the pinion 26 and the output pinions 24 and 25, so that the carriage 15 can be vertically displaced along the rack 12 and, accordingly, also along the corresponding mast 3, 4.

Shown by FIGS. 5 and 6 is the constructional configuration of the working platform 16 as well as of the carriage 14. The carriage 14 is guided on the mast 3. To this end the carriage 14 has the motor supporting plate 22 which is aligned parallel to the longitudinal extension of the mast 3. On this motor supporting plate 22 the guide rolls 38 and 39 are arranged in a manner such as to roll off on both sides against a sectional support 23 of the mast 3.

Screwed to the motor supporting plate 22 is the transmission unit 31, so that the two output pinions 24 and 25 mesh with the rack 12. Above the transmission 31 the carriage 14 comprises orthogonally extending profiles 32 which are connected to a profile 33 extending at right angles thereto, and which are supported vis a vis the motor supporting plate 22 by means of a further, inclined profile 34. On the supporting bracket 35 of the carriage 14 formed by the profiles 32, 33 and 34 bearing devices are fixed at a distance to each other, with a wire gauge 37 being arranged as a force-sensing device between the bearing devices and the supporting bracket 35. The forces received by the wire gauge 37 are, in a manner not further described, supplied to a computer which is connected to the driving motors 19 of the elevating platform 1 through an electric control device.

Above each bearing device a joining element 40 is arranged which connects the working platform 16 to the carriage 14. Each joining element 40 consists of a rod 41 stationary with the working platform 16 and of a holding device 42 configured as a bearing shell, which holding device is pot-shaped and is covered on the open end thereof by a lid 43. Within said holding device 42 a spherical member 44 is supported. The spherical member has a bore which is penetrated by the rod 41. In addition, said rod 41 penetrates two radially arranged openings in the bearing device 42 and is fixed on the working platform 16 by means of angle members 45.

The above-described joining elements 40 enable the working platform 16 to move in the longitudinal direction of the working platform 16 relative to the masts 3 and 4. In addition, said joining elements 40 enable the working platform 16 to perform a relative rotational movement about the shafts of the output pinions 24. Thereby a difference of level that possibly occurs between the two driving units of the carriages 14 and 15 on the masts is compensated, so that a differing lifting movement of the carriages 14 and 15 relative to each other is possible to a limited extent. Additionally, it is possible by means of the arrangement of the joining elements 40 in combination with the wire gauges 37 to determine the static load of the working platform 16 with regard to the magnitude and the location of the load. The forces detected by means of the wire gauges 37 are evaluated in a computer not further shown and are used for switching the driving motors off as soon as a static overload is reached.

For the relative movement of the working platform 16 with regard to the carriage 14 or 15 it is required that the openings in the holding device 42 arc formed slightly larger than the diameter of the rod 41. In contrast thereto, the bore in the spherical member 44 can exactly agree with the diameter of the rod 41, since here only the necessary axial movement is intended.

Finally, in FIG. 7 the joining element 40 between the working platform 16 and one of the carriages 14 or 15 is shown in detail in three views.

What is claimed is:

1. An elevating work platform comprising:

at least two mutually parallel masts;

a carriage for each mast guided on the respective mast;

a working platform which is guided for vertical movement on the mast and being supported on the carriages by means of joining elements which allow a limited displacement of the working platform relative to the carriages in the longitudinal axis direction of the working platform and a rotation of the working platform relative to the carriages about an axis extending at right angles to the longitudinal axis direction of the working platform, wherein each joining element consist of a cylindrical rod and a spherical member supported in a holding device, and that the capacity of rotation of the working platform relative to the carriages is limited.

2. The elevating platform according to claim 1, wherein the rod is stationary with the working platform, and the spherical member is movable relative to the rod.

3. The elevating platform according to claim 1, wherein that the rod is supported in a bore which radially penetrates said spherical member.

4. The elevating platform according to claim 1, wherein each carriage has two joining elements comprises two rods which are supported in corresponding spherical members.

5. The elevating platform according to claim 1, wherein the holding device is configured as a pot-shaped bearing shell which has radially opposing openings that receive the rod.

6. The elevating platform according to claim 5, wherein the bearing shell is closed by a lid.

7. The elevating platform according to claim 1, wherein the holding device is supported on a profile of the carriage, under the interposition of a force-sensing device.

8. The elevating platform according to claim 7, wherein the force-sensing device is in the form of a wire gauge.

9. The elevating platform according to claim 1, wherein each carriage has two joining elements with associated force-sensing devices.

* * * * *